US005771653A

United States Patent [19]

Dolati et al.

[11] Patent Number: 5,771,653

[45] Date of Patent: Jun. 30, 1998

[54] CHORD FOR USE AS THE UPPER AND LOWER CHORDS OF A ROOF TRUSS

[75] Inventors: Masoud Dolati, Alpharetta; Rahim A. Zadeh, Fayetteville, both of Ga.; Charles C. Hoover, Haines City, Fla.; David R. Willis, Arlington; John C. Carpenter, Halletsville, both of Tex.

[73] Assignee: Unimast Incorporated, Schiller Park, Ill.

[21] Appl. No.: 729,549

[22] Filed: Oct. 11, 1996

Related U.S. Application Data

[60] Provisional application No. 60/005,102 Oct. 12, 1995.

[51] Int. Cl. [6] ..... E04C 3/30

[52] U.S. Cl. ..... 52/737.6; 52/715; 52/732.1; 52/696; 52/550; 52/93.1; 52/545; 52/547

[58] Field of Search ..... 52/733.2, 702, 52/737.6, 724.1, 732.1, 710, 715, 454, 547, 549, 550, 739.1, 639, 696, 690

[56] References Cited

U.S. PATENT DOCUMENTS

| | | | |
|---|---|---|---|
| D. 25,034 | 12/1895 | Hunter . | |
| D. 25,413 | 4/1896 | Jones . | |
| 2,169,253 | 8/1939 | Kotrbaty . | |
| 2,169,255 | 8/1939 | Kotrbaty . | |
| 3,004,640 | 10/1961 | Macomber . | |
| 3,018,862 | 1/1962 | Litteral et al. . | |
| 3,029,914 | 4/1962 | Macomber . | |
| 3,541,749 | 11/1970 | Troutner . | |
| 3,686,819 | 8/1972 | Atkinson . | |
| 4,106,253 | 8/1978 | Aarons | 52/550 X |
| 4,130,977 | 12/1978 | Talyor, Jr. et al. . | |
| 4,141,191 | 2/1979 | Aarons . | |
| 4,476,662 | 10/1984 | Fisher | 52/690 X |
| 4,616,453 | 10/1986 | Sheppard, Jr. et al. | 52/93.1 |
| 4,651,484 | 3/1987 | Rutkowski | 52/733.3 X |
| 4,691,494 | 9/1987 | Gwynne . | |
| 4,878,323 | 11/1989 | Nelson | 52/690 X |
| 4,918,899 | 4/1990 | Karytinos | 52/690 |
| 4,986,051 | 1/1991 | Meyer et al. . | |
| 5,417,028 | 5/1995 | Meyer | 52/737.6 |
| 5,577,353 | 11/1996 | Simpson | 52/696 X |

FOREIGN PATENT DOCUMENTS

| | | |
|---|---|---|
| 49108/72 | 11/1972 | Australia . |
| 491358 | 7/1974 | Australia . |

OTHER PUBLICATIONS

Brochure—"Light Gauge Steel" Alpine Construction Harware, Summer 1996.

*Primary Examiner*—Wynn Wood Coggins
*Attorney, Agent, or Firm*—Frost & Jacobs LLP

[57] ABSTRACT

An integral, one-piece, metallic chord for use as the top and bottom chords of a roof truss. The chord comprises an elongated member of generally U-shaped, singly symmetric cross-section, having a base terminating at its longitudinal edges in mirror image legs. The base portion is planar with a central depressed rib formed therein and extending the length thereof. Each leg comprises a first planar portion perpendicular to and extending from its respective longitudinal edge of the base, followed by an inwardly sloped planar portion leading to a planar attachment portion which is perpendicular to the base portion and which terminates in a flange portion extending outwardly of the attachment portion and then upwardly and inwardly, ending in a longitudinal edge facing the attachment portion. The flange portions form semi-closed reinforcement members. The legs and their flange portions constitute the sides of the chord. The first planar portion of each leg and the outermost part of the flange portion of each leg are co-planar, so that the chord will lie flat on either of its sides.

22 Claims, 3 Drawing Sheets

CHORD FOR USE AS THE UPPER AND LOWER CHORDS OF A ROOF TRUSS

REFERENCE TO RELATED APPLICATION

This is an application based upon an earlier filed provisional application, Ser. No. 60/005,102, filed Oct. 12, 1995, in the name of the same inventors, and entitled STRUCTURAL SUPPORTS.

TECHNICAL FIELD

The invention relates to a metallic chord which can serve as both the upper and lower chords of a roof truss, and more particularly to such a chord which has a simplified, substantially U-shaped cross-section of the same transverse width adjacent its closed end and adjacent its open end.

BACKGROUND ART

In recent years, there has been considerable interest in metallic roof trusses, as opposed to wood trusses, since they are lighter in weight, stronger, fire and termite resistant, consistent in quality and not subject to shrinkage. While roof trusses may take on various shapes, the most commonly encountered shape is defined by two upper chords joined at their adjacent ends and sloping downwardly and outwardly. The upper chords are attached to a lower chord to form an overall triangular truss. Bracing members are provided between the lower chord and the upper chords, such members being generally referred to as "webs".

Prior art workers have devised a number of chords of different cross-sectional configurations for use in the manufacture of roof trusses. There are, for example, chords having cross-sections which are C-shaped, Z-shaped, hat-shaped and triangular. Each of these configurations has certain drawbacks.

U.S. Pat. No. 4,986,051 teaches a chord which has a cross-sectional configuration which is somewhat U-shaped. The cross-sectional configuration is made up of longitudinally extending planar portions of a width not exceeding that which will comply with a particular formula set forth in the patent. The patent also indicates that maximum use is made of reinforcing ribs.

The present invention is based upon the discovery that chords can be provided with an even simpler U-shaped cross-section. The chords of the present invention, when made of steel, were designed to meet AISI (American Iron and Steel Institute) code and formulas, as set forth in the current edition of The AISI Cold Formed Steel Design Manual.

In use, a truss chord develops positive or negative moments, depending upon the load it is sustaining. For example, snow applies a gravity load, while wind applies an uplift load. Both positive and negative moments are at work at all times and despite the number and arrangement of webs, these moments are still there and must be considered. There are also axial forces, both tension and compression, which must be considered as well.

The chords of the present invention have a number of advantages over the prior art which may be stated as follows. The chord cross-section is singly symmetric and semi-closed. The cross-section was modeled to have approximately equal moment capacity in both major axis bending directions, i.e. whether bowed upwardly or downwardly by upwardly or downwardly directed forces. Most prior art chord sections have significantly less moment capacity in one direction, than in the other. The cross-sectional shapes of the chords of the present invention are based upon proportions derived for both geometric reasons and strength reasons. As a result of this, fewer chord panels are required, resulting in fewer webs and less material and labor. The invention enables longer panels and varied panels, while the prior art generally follows what is considered to be "conventional spacing" of webs. The strength provided by the chords of the present invention enables the use of lighter gauge material. In the case of "C"-shaped chords and "Z"-shaped chords, generally 16 gauge steel is used, whereas the chords of the present invention may be made of 22 gauge steel.

The chord section of the present invention has greater resistance to torsional buckling (i.e. twisting) than other singly symmetric shaped sections, particularly "C"-shaped sections and "Z"-shaped sections. The combination of the cross-sectional shape of the chords of the present invention, together with the use of high yield strength steel provides the chords with a very high strength to weight ratio.

The chords of the present invention demonstrate superior lateral strength as compared to "C"-shaped chords, "Z"-shaped chords, and "hat"-shaped chords. This is due to the overall shape of the chords of the present invention and the shape of the flange portions of the legs. This results in greater resistance to minor axis buckling during handling.

The particular outwardly, upwardly and inwardly directed shape of the leg flange portions of the present invention increases their stiffening power and prevents hang up of the edges on objects on a jig table or on the top of a wall along which the chord is pushed or dragged and makes the chord safer to handle. Furthermore, the particular configuration of the flange portions of the chord legs enables installers to walk on the bottom chord of a truss without twisting and bending the chord. Such twisting and bending can occur with "C"-shaped and "Z"-shaped bottom chords, as well as with triangular bottom chords and the bottom chord of the above-noted U.S. Pat. No. 4,986,051.

That part of each leg of the chords of the present invention, adjacent the closed end of the chord cross-section, and the upwardly directed part of the flange portion of each leg are co-planar, with the result that the chords will lie flat on either of their sides on an assembly table making truss assembly much easier. This also enables trusses to be stacked, either for storage or during transport to a construction site. This same configuration assures that fasteners located in the attachment portions of the legs are behind the plane defined by the co-planar parts of each leg to prevent snagging. Furthermore, a one-sided fastener, such as a self-topping screw, can enter one attachment portion of the chord, pass through a web and the other attachment portion of the chord without going into the assembly table.

As will be described hereinafter, it is preferable to make the chords of the present invention in a larger size for use in trusses having spans up to about 80 feet and in a smaller size for use in trusses having spans up to about 45 feet. The smaller size enables the use of available hangers, hardware and accessories employed with trusses of wood construction.

The legs or sides of the larger chords of the present invention enable reinforcement members of channel-shaped cross-section to be affixed to the chord sides for additional strength. This allows the reinforcing of a chord at over-stressed areas thereof, rather than going to a heavier gauge for the entire chord.

The chords of the present invention do not require coping or special cuts to assemble the trusses. The chord cross-section receives the ends of web members with a slight frictional fit, thus facilitating truss assembly. Chords of the present invention can be nested and packaged for shipping ease and efficiency.

A truss made with the chords of the present invention is about one-half the weight of a similar wood truss and is about 30 percent less than the weight of a truss made with "C"-shaped and "Z"-shaped chords. The light weight of trusses made of chords of the present invention makes job site handling far easier and less labor intensive.

As will be apparent hereinafter, the 20 gauge of the smaller chords of the present invention allows faster and easier sheathing for the ceiling and the plywood for the roofing, compared to the equivalent "C"-cross-section or the "Z"-cross-section chords of 18 gauge or thicker. Unlike chords of triangular cross-section, the chords of the present invention do not have to be closed with mechanical fasteners in order to function.

DISCLOSURE OF THE INVENTION

According to the invention, there is provided an integral, one-piece, metallic chord for use as the top and bottom chords of a roof truss. The chord comprises an elongated member of a substantially U-shaped cross-section. The cross-section is singly symmetric, being closed at one end and open at the other.

The cross-section is made up of a base terminating at its longitudinal edges in legs. The legs are mirror images of each other. The base portion is planar with a central depressed arcuate rib formed therein, the rib extending the length of the base.

Each leg comprises a first planar portion perpendicular to the base and extending from the adjacent edge of the base. The first planar portion is followed by an inwardly sloped planar portion. The inwardly sloped planar portion leads to a planar attachment portion which, in turn, terminates in a flange portion. The planar attachment portions of the legs are parallel to each other and perpendicular to the base, and are spaced from each other by a distance enabling webs to be located therebetween with a friction fit.

The flange portion of each leg extends outwardly from the attachment portion and then upwardly and inwardly, ending in a longitudinal edge which faces the attachment portion.

The legs and their respective flange portions constitute the sides of the chord. The first planar portion of each leg and the outermost part of the flange portion of that leg are co-planar so that the chord will lie flat on either side during truss assembly, and so that the assembled trusses can be stacked.

DETAILED DESCRIPTION OF THE INVENTION

Figure 1:
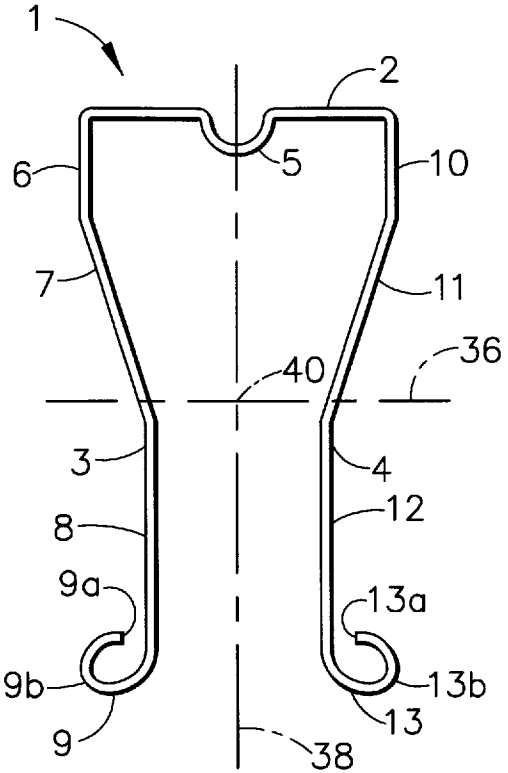
FIG. 1 is an end elevational view of the smaller chord of the present invention.

Reference is first made to FIG. 1 which constitutes an end elevational view of the smaller chord of the present invention. The chord is generally indicated at 1 and is intended primarily for use in residential and light commercial structures requiring a roof truss having a span of up to about 45 feet. The chord may be used as both the upper chords and the lower chord of the roof truss, as will be apparent hereinafter. In FIG. 1, the chord 1 is shown in its orientation for an upper roof truss chord. When used as a lower roof truss chord, it would be inverted, again as will be apparent hereinafter. The chord 1 is shaped by a rolling process, as is well known in the art. The chord 1 may be made of any appropriate metallic material such as aluminum or other metals or metal alloys. In many instances it is desirable to provide the metallic chord with a protective coating. The protective coating may be metallic or non-metallic such as paint, epoxy, or the like. For purposes of an exemplary showing, the chord 1 may be considered to be made of high yield strength galvanized steel of 22, 20 or 18 gauge.

As is evident from FIG. 1, the chord is generally U-shaped, having a base 2 and a pair of legs 3 and 4. The base 2 is planar throughout the length of the chord and has a central, depressed, arcuate stiffening rib 5 formed therein and extending the length thereof. At its longitudinal edges, the base 2 terminates in legs 3 and 4 which are mirror images of each other.

Leg 3 has a first planar portion 6. The portion 6 is perpendicular to base 2. The portion 6 is followed by a planar, inwardly sloping portion 7. The portion 7 terminates in a planar portion 8 which serves as an attachment portion and which is perpendicular to the base 2 and parallel to leg portion 6. At its lowermost end, the attachment portion 8 is provided with a flange 9. The flange 9 extends outwardly and is curled so that its longitudinal edge 9*a* faces the attachment portion 8. The outermost part 9*b* of flange 9 is co-planar with leg portion 6.

Leg 4, being a mirror image of leg 3, comprises a planar portion 10 corresponding to portion 6 of leg 3; a inwardly sloping planar portion 11 corresponding to portion 7 of leg 3; and an attachment portion 12 equivalent to attachment portion 8 of leg 3. The attachment portion 12 of leg 4 terminates in a flange 13, the edge 13*a* of which faces attachment portion 12. The outermost portion 13*b* of flange 13 is co-planar with leg portion 10. The leg portions 6 and 10 are of importance since they provide a planar width of steel which helps accommodate axial and moment forces. Since the leg portions 6 and 10 are co-planar with the portions 9*b* of flange 9 and 13*b* of flange 13, respectively, the chord 1 can be laid on either side on a horizontal assembly surface during assembly of a truss. When on either of its sides, the attachment surfaces 8 and 12 will be parallel to the supporting surface. This greatly facilitates truss assembly. In addition, it greatly facilitates the stacking of trusses during storage and transportation.

In an exemplary but non-limiting embodiment, the base 2 has a width of 1.5 inches. The outside dimension between the portions 9*b* and 13*b* of flanges 9 and 13 is also 1.5 inches. The overall vertical height of the chord (as viewed in FIG. 1) is 2.75 inches. Again, as viewed in FIG. 1 and along a vertical line, the distance from the bottom to the top of the flanges 9 and 13 is 0.25 inch, the distance from the top of the flanges to the juncture of portions 7 and 8 or portions 11 and 12 is 1 inch. The vertical distance between the juncture of portion 7 and 8 and the juncture of portions 6 and 7 and the vertical distance between the juncture between portions 11 and 12 and the juncture between portions 10 and 11 are each 1 inch. Finally, the vertical width of each of the portions 6 and 10 is 0.50 inch.

The distance between leg portions 8 and 12 is 0.75 inch and the radius of the arcuate rib 5 is 0.125 inch. The dimensions of the smaller chord 1 are such as to render it compatible with available joist hangers, truss hangers, and other accessories normally used with wood trusses. It is preferred that metallic webs to be attached to chord 1 are so sized as to have a slight friction fit between leg portions 8 and 12, to facilitate joist assembly.

Figure 2:
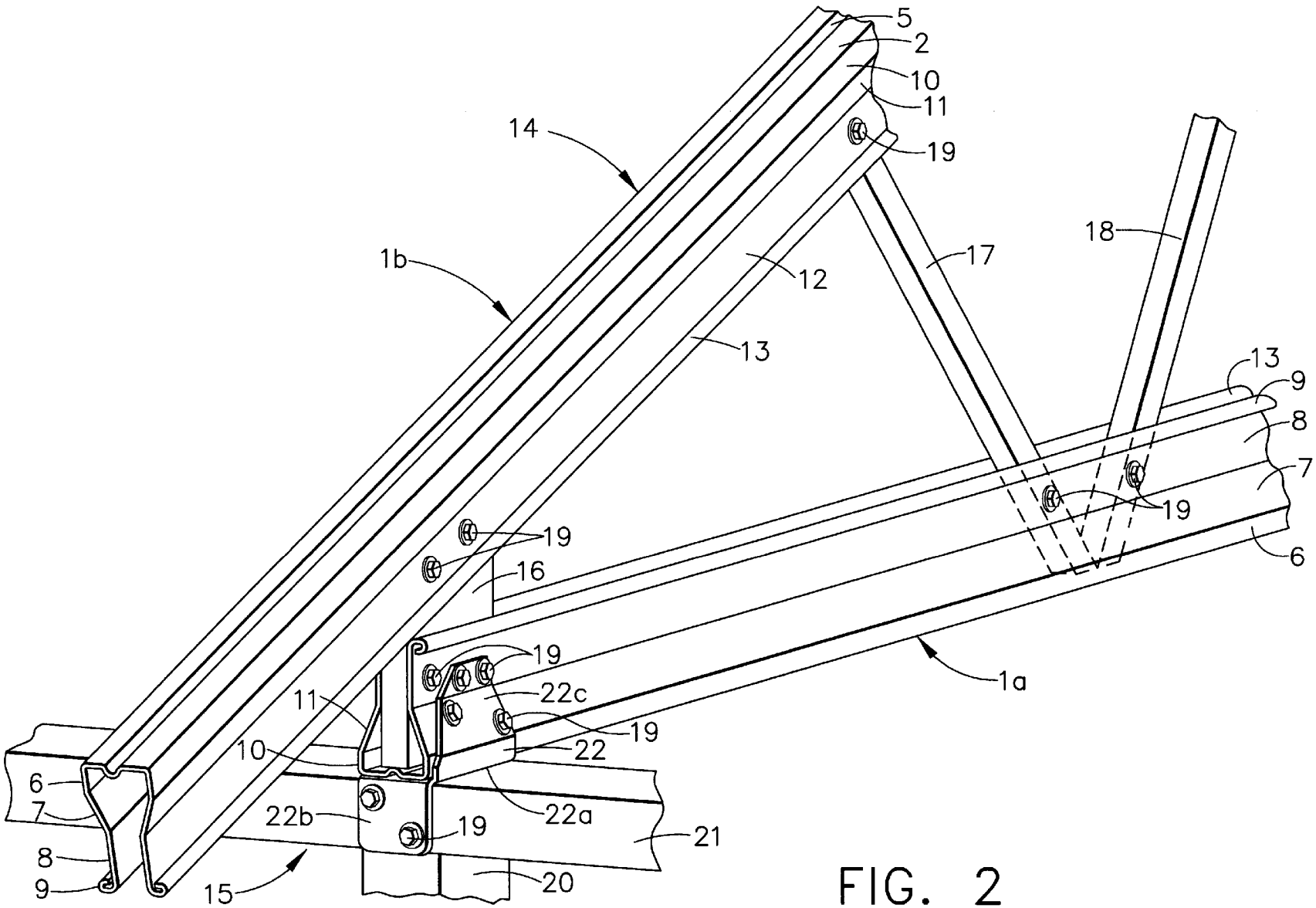
FIG. 2 is a fragmentary perspective view illustrating the use of the chord of FIG. 1 as both a top chord and a bottom chord of a roof truss, the truss being fastened to wall members.

Reference is now made to FIG. 2 which shows an exemplary truss assembly utilizing the chord of FIG. 1. In FIG. 2, a fragmentary portion of a truss is generally indicated at 14 and a fragmentary portion of a wall is generally indicated at 15. The bottom chord (identical to the chord 1 of FIG. 1) is generally indicated at 1*a*. A top chord (identical to the chord 1 of FIG. 1) is generally indicated at 1*b*. It will be understood that roof truss 14 may be substantially triangular in configuration and, under these circumstances, there would be a second oppositely sloping upper chord (not shown). The top chord 1*b* and the bottom chord 1*a* are interconnected by webs, three of which are shown at 16, 17 and 18. Excellent results are achieved when the webs are tubular numbers of square or rectangular cross section. The arrangement of webs and the number of webs used is dependent upon the length of the truss and the anticipated loads and forces. As indicated above, with chord members such as chord 1*a* and 1*b*, the number of webs can generally be less than the number usually required by prior art chords. The webs 16, 17 and 18 are attached to chords 1*a* and 1*b* by appropriate fastening means such as bolts, self-tapping screws, welds, or the like. For purposes of an exemplary showing, the fasteners are illustrated as self-tapping screws 19. The self-tapping screws pass through the attachment portions 8 and 12 of the chords 1*a* and 1*b*. It is possible to use more than one fastener per web in attachment portions 8 and 12. The fasteners may be positioned one above the other or side-by-side. In FIG. 2, the web 16 is shown resting upon rib 5 of chord 1*a*. While this is often the case, contact between the rib 5 and the web is not always required and is not always present.

The walls are usually made up of a plurality of vertical studs 20. For purposes of an exemplary showing, a typical metal stud is illustrated in FIG. 2. A row of spaced studs 20 is generally capped by an elongated channel-shaped track 21. There are many ways to attach a truss 14 to a wall 15, and the prior art has devised many types of bracket-like hardware elements for this purpose. An exemplary bracket is shown at 22. The bracket has a base 22*a* which rests upon the top of track 21. The base has front and rear downwardly depending flanges lying along the sides of track 21. One such flange is shown at 22*b* attached to the adjacent track side by fasteners 19. The bracket 22 also has a pair of side flanges, one of which is shown at 22*c*. The bracket side flanges are generally configured to match the shape of the sides 3 and 4 of chord 1*a* and are attached to the chord portions 7–8 and 11–12 by additional fasteners 19. It will be apparent that the chord flanges 9 and 13 provide non-sharp, reinforced edges for workmen to stand on during construction. The upper chord 1*b* is attached to webs 16, 17 and 18 in the same manner as is bottom chord 1*a*.

Figure 3:
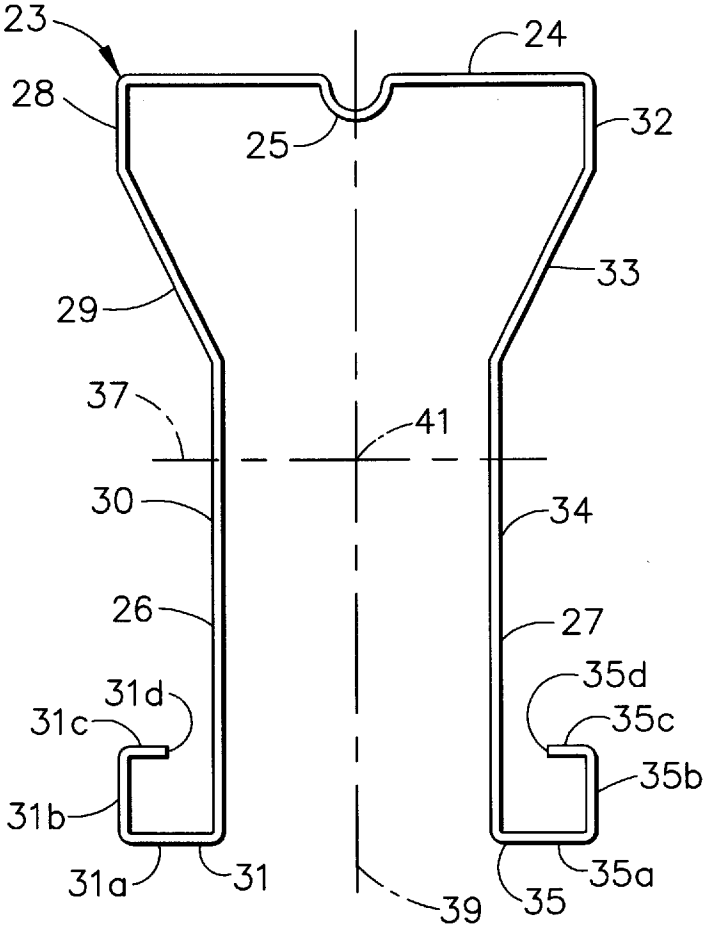
FIG. 3 is an end elevational view of the larger chord of the present invention.

Reference is now made to FIG. 3 which comprises an end view of a second embodiment of the present invention which is somewhat larger than the embodiment of FIG. 1. The chord of FIG. 3, generally indicated at 23, can be used in any size structure, but is particularly adopted for use in commercial buildings or the like requiring a span greater than 45 feet and up to about 80 feet. As in the case of chord 1 of FIG. 1, the chord 23 of FIG. 3 is an integral, one-piece structure formed from a metallic strip of appropriate width by a rolling process well known in the art. The chord 23 may be made of any of those metallic materials set forth with respect to chord 1, and may be provided with a protective coating, as set forth with respect to chord 1. Again, for purposes of an exemplary showing, the chord will be described as made of galvanized high yield strength steel of 22, 20, 18 or 16 gauge.

The chord 23 has a base 24, similar to the base 2 of chord 1 and having a central, depressed, arcuate rib 25 extending the length thereof. The base 24 terminates in a pair of mirror image legs 26 and 27. Leg 26 comprises a first planar portion perpendicular to base 25 and equivalent to portion 6 of leg 3 of FIG. 1. The portion 28 leads to an inwardly sloping portion 29, similar to the portion 7 of leg 3. The portion 29 is planar and leads to a planar attachment portion 30 which is perpendicular to base 24 and similar to the attachment portion 8 of leg 3 of FIG. 1. The attachment portion 30 terminates in a flange 31. The flange 31 has an outwardly directed portion 31*a*, an upwardly directed portion 31*b* and an inwardly directed portion 31*c* which terminates in a longitudinal edge 31*d* facing the attachment portion 30.

Mirror image leg 27 has a first portion 32 equivalent to leg portion 28 and perpendicular to base 24. The portion 32 is planar and leads to a planar inwardly sloped portion 33, equivalent to leg portion 29. Inwardly sloped portion 33 leads to planar attachment portion 34 which, itself, terminates in a flange 35. The flange 35 has portions 35*a*, 35*b* and 35*c*, equivalent to flange portions 31*a*, 31*b* and 31*c*. The flange portion 35*c* terminates in a longitudinal edge 35*d* which faces attachment portion 34. As in the case of edges 9*a* and 13*a* of chord 1, the edges 31*d* and 35*d* of chord 23 are in-turned so that workmen handling the chord are protected therefrom. As is the case of chord 1 of FIG. 1, the chord 23 of FIG. 3 can be used both as a top chord and a bottom chord of a truss. The surfaces 28 and 31*b* are co-planar, and the surfaces 32 and 35*b* are similarly co-planar so that the chord 23 can lie flat on a horizontal assembly surface with attachment portions 30 and 34 parallel to the assembly surface to facilitate the assembly of a roof truss utilizing the chord 23. Again, the planar surfaces 28 and 32 of chord 23 provide a planar width of steel to accommodate axial and moment forces. The surfaces 28, 32, 31*b* and 35*b* serve an additional purpose which will be set forth hereinafter.

In an exemplary, but non-limiting, embodiment of the chord 23 of FIG. 3, the base has a width of 2.5 inches. The rib 25 has a radius of 3/16 inch. The overall height of chord 23, as viewed in FIG. 3, is 4 inches. Portions 28 and 32 have a width of 0.5 inches, as do portions 31*b* and 35*b* of flanges 31 and 35, respectively. Flange portions 31*a* and 35*a* have a width of 0.5 inch while the in-turned portions 31*c* and 35*c* each have a width of 0.25 inch. The distance between the top of in-turned flange 31*c* and the juncture of planar portions 29 and 30 represents the vertical dimension of the exposed portion of attachment portion 30 and is 2 inches. The same is true of the exposed portion of attachment portion 34. The vertical distance between the juncture of planar portions 29 and 30 and the juncture of planar portion 28 and 29 is 1 inch. The same is true of the similarly defined distance with respect to leg 27. The distance between the inside surfaces of attachment portions 30 and 34 is 1.5 inches.

The major axes of chords 1 and 23 are shown at 36 and 37, respectively. The minor axes of chord 1 and chord 23 are shown at 38 and 39, respectively. The longitudinal axes of chord 1 and chord 23 are shown at 40 and 41, respectively.

Figure 4:
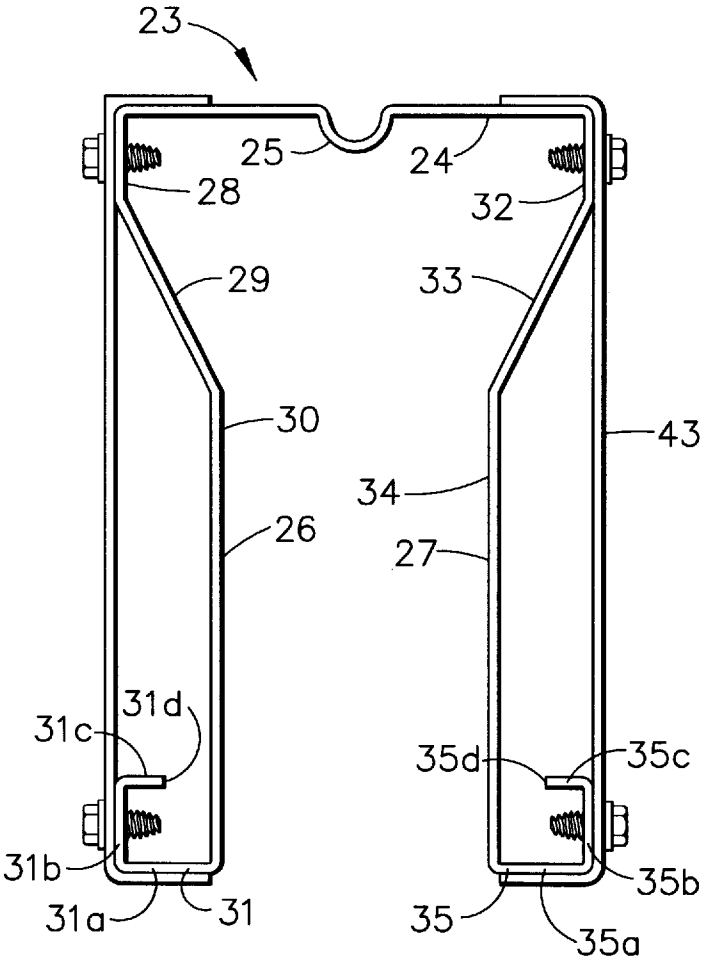
FIG. 4 is an end elevational view, similar to FIG. 3, and illustrating the chord provided with channel-shaped reinforcement members.

The exposed width of 2 inches with respect to attachment portions 30 and 34 of chord 23 enables the placement of up to three fasteners therethrough in a vertical row. The fact that surfaces 28 and 31*b* and surfaces 32 and 35*b* are co-planar enables the chord to be reinforced as shown in FIG. 4. Reference is made to FIG. 4. FIG. 4 is an end elevational view of the chord 23 of FIG. 3, and like parts have been given like index numerals. In FIG. 4, the sides 26 and 27 of chord 23 have been reinforced by channel-shaped reinforcement tracks 42 and 43. The reinforcement track 42 overlies surfaces 31*a*, 31*b* and 28 of leg 26, as well as a portion of base 24. Reinforcement track 42 is attached to portions 31*b* and 28 by appropriate fasteners such as self-taping screws 44. In a similar fashion reinforcing track 43 overlies portions 35*a*, 35*b* and 32 of leg 27, along with a portion of base 24.

The reinforcement tracks 42 and 43 can be of any length and can be located anywhere along the chord 23. More than one pair of reinforcement tracks can be used on a chord. This allows reinforcing at over-stressed areas of the chord, rather than having to resort to a heavier gauge chord.

It will be understood by one skilled in the art that the assembly of a truss utilizing the chord 23 of FIG. 3 can be similar to that described with respect to chord 1 and FIG. 2.

Both embodiments of the present invention possess the advantages enumerated above. Even with respect to prior art chords of a substantially U-shaped configuration, the proportions and configurations of the embodiments of the present invention are quite different. For example, in both embodiments the distance between the attachment portions of the legs is at least one half the width of the base. Both embodiments are provided with only one rib, making the manufacture of the chords far easier, and requiring proportionately less material.

Modifications can be made in the invention without departing from the spirit of it.

What is claimed:

1. An integral, one-piece, metallic chord for use as the top and bottom chords of a roof truss, said chord comprising an elongated member of generally U-shaped, singly symmetric cross-section having a planar base terminating in longitudinal edges, mirror image legs extending from said base longitudinal edges and extending the length of said base, said base having a central depressed rib formed therein and extending the length thereof, each of said legs comprising a first planar portion perpendicular to said base and extending from the adjacent one of said longitudinal edges thereof, said first planar portion leading to an inwardly sloped planar portion, said inwardly sloped planar portion leading to a planar attachment portion perpendicular to said base and having an area through which fasteners may extend, said attachment portion terminating in an outwardly directed flange ending in an edge and being so configured that said edge faces said attachment portion, said flange comprising a semi-closed reinforcement member, said first planar portion of each leg and the outermost part of the flange of said leg being co-planar, whereby said chord can lie flat on either of its legs on a support surface with said attachment portions parallel to said support surface.

2. The chord claimed in claim 1 wherein said chord is stackable with other similar chords.

3. The chord claimed in claim 1 wherein said chord is made of high yield strength steel.

4. The chord claimed in claim 1 wherein said legs are rib free.

5. The chord claimed in claim 1 wherein said chord is sized for structures requiring a span of up to about 45 feet.

6. The chord claimed in claim 1 wherein said chord is sized for structures requiring a span of up to about 80 feet.

7. The chord claimed in claim 1 wherein the distance between said attachment portions of said legs is at least half the width of said base.

8. The chord claimed in claim 1 including webs for use therewith, said webs being receivable between said attachment portions of said chord with a friction fit.

9. The chord claimed in claim 1 wherein said chord is made of metallic material chosen from the class consisting of aluminum, metal alloys, and high yield strength steel.

10. The chord claimed in claim 1 wherein said chord is made of steel chosen from the class consisting of 22 gauge high yield strength steel, 20 gauge high yield strength steel, 18 gauge high yield strength steel and 16 gauge high yield strength steel.

11. The chord claimed in claim 1 including a protective coating on said chord.

12. The chord claimed in claim 3 wherein said steel is galvanized.

13. The chord claimed in claim 5 wherein said chord is made of steel chosen from the class consisting of 22 gauge high yield strength steel, 20 gauge high yield strength steel and 18 gauge high yield strength steel.

14. The chord claimed in claim 5 wherein said flanges are curled.

15. The chord claimed in claim 6 wherein said chord is made of steel chosen from the class consisting of 22 gauge high yield strength steel, 20 gauge high yield strength steel, 18 gauge high yield strength steel and 16 gauge high yield strength steel.

16. The chord claimed in claim 6 wherein said flanges of said chord legs each comprising a first planar portion extending outwardly and perpendicularly from its respective attachment portion, a second planar portion parallel to its respective attachment portion and a third planar portion perpendicular to and extending toward its respective attachment portion and terminating in said edge facing its respective attachment portion, each flange, together with a portion of its respective attachment surface, forming a box-like reinforcement member, said second planar portion of said flange of each leg being co-planar with said first planar portion of its respective leg.

17. The chord claimed in claim 6 wherein said chord is stackable with other similar chords.

18. The chord claimed in claim 6 wherein said legs are rib free.

19. The chord claimed in claim 6 wherein the distance between said attachment leg portions is at least half the width of said base.

20. The chord claimed in claim 6 including at least one pair of reinforcement tracks therefor, each reinforcement track comprising a channel-shaped member having a planar body with legs extending perpendicularly and in the same direction from the longitudinal edges of said body, each reinforcement track body being affixable with fastening means to the first planar portion and the second planar flange portion of a leg of said chord with one of said reinforcement track legs overlying a portion of said base and the other of its legs overlying the first planar portion of the flange to which it is attached.

21. The chord claimed in claim 13 wherein said steel is galvanized.

22. The chord claimed in claim 15 wherein said steel is galvanized.

* * * * *